United States Patent [19]

Kulischenko

[11] 4,417,879

[45] Nov. 29, 1983

[54] FLEXIBLE SHAFT STICK CONTROL MECHANISM FOR STEERING MARINE VESSELS

[75] Inventor: Walter Kulischenko, East Brunswick, N.J.

[73] Assignee: Pennwalt Corporation, Philadelphia, Pa.

[21] Appl. No.: 286,814

[22] Filed: Jul. 27, 1981

Related U.S. Application Data

[63] Continuation-in-part of Ser. No. 268,539, May 29, 1981.

[51] Int. Cl.[3] ..... B63H 21/26

[52] U.S. Cl. ..... 440/62; 440/63; 114/144 R

[58] Field of Search ..... 440/62, 63, 53, 58; 114/144 R; 74/496, 495, 543

[56] References Cited

U.S. PATENT DOCUMENTS

| | | | |
|---|---|---|---|
| 2,087,647 | 7/1937 | Larkins | 114/144 R |
| 3,085,447 | 4/1963 | Shay | 114/144 R |
| 3,417,723 | 12/1968 | Akermanis | 114/144 R |
| 3,559,612 | 2/1971 | Patterson | 440/63 |
| 3,659,475 | 5/1972 | Nichols | 440/62 |
| 3,810,440 | 5/1974 | Johnson, Jr. | 114/162 |
| 3,983,834 | 10/1976 | Hirmann | 440/63 |
| 4,185,473 | 1/1980 | Troost | 440/62 |
| 4,327,658 | 5/1982 | Kulischenko | 114/144 R |

*Primary Examiner*—Trygve M. Blix
*Assistant Examiner*—C. T. Bartz

[57] ABSTRACT

A compact, gearless steering control unit for open fishing boats, for example, employs a pivoting stick or rod to control steering rather than a conventional steering wheel. The unit includes a plurality of pulleys and timing belts to rotate a flexible shaft which controls a steering member. The stick is centrally disposed enabling either front seat occupant to easily move it, or at either side of the boat. By eliminating the protruding steering wheel, the front seat fisherman have additional room to manipulate their gear. The steering control stick may readily be removed to deter theft of the vessel.

1 Claim, 7 Drawing Figures

FLEXIBLE SHAFT STICK CONTROL MECHANISM FOR STEERING MARINE VESSELS

This application is a continuation-in-part of my copending application Ser. No. 268,539, filed May 29, 1981, for "Flexible Shaft Stick Control Unit for Steering Marine Vessels" assigned to the same assignee hereof.

STATEMENT OF THE INVENTION

This invention relates to a flexible shaft stick control system for steering sport fishing boats such as trolling boats and the like.

BACKGROUND AND SUMMARY OF THE INVENTION

Prior art systems for steering smaller marine boats, in the main, employ steering wheels, gearing, push-pull cables, and combinations thereof. The disadvantages of gear mechanisms and push-pull cables in marine boat steering systems are discussed in U.S. Pat. No. 4,173,937 to Kulischenko et al. The present invention employs no gearing or push-pull cables, and even eliminates the steering wheel required in the aforementioned patent, and additionally provides a compact integral unit which may be conveniently mounted between the two front seats enabling either occupant to readily steer the vessel, or at either side of the boat.

Either fisherman steering the vessel should have ample room to manipulate his fishing gear without being impeded by a protruding steering wheel, as in the prior art. Further, the vessel can be steered with the knee or foot when the fisherman's hands are preoccupied, and yet the vessel will maintain a steady course when the steering control mechanism is left unattended.

The present invention provides a flexible shaft stick control remote steering unit requiring no gears or push-pull cables. The stick may be mounted between the front seats enabling steering by either occupant or at the side of the boat. The stick may be moved 90° from vertical, either forward or backward, or from side to side, to steer the vessel full left or full right, by means of a flexible shaft, pulleys, timing belts and a ball screw cylinder, or the like. Additionally, the steering control unit stick is readily removable from the vessel to deter its theft.

DETAILED DESCRIPTION OF THE INVENTION

Figure 1:
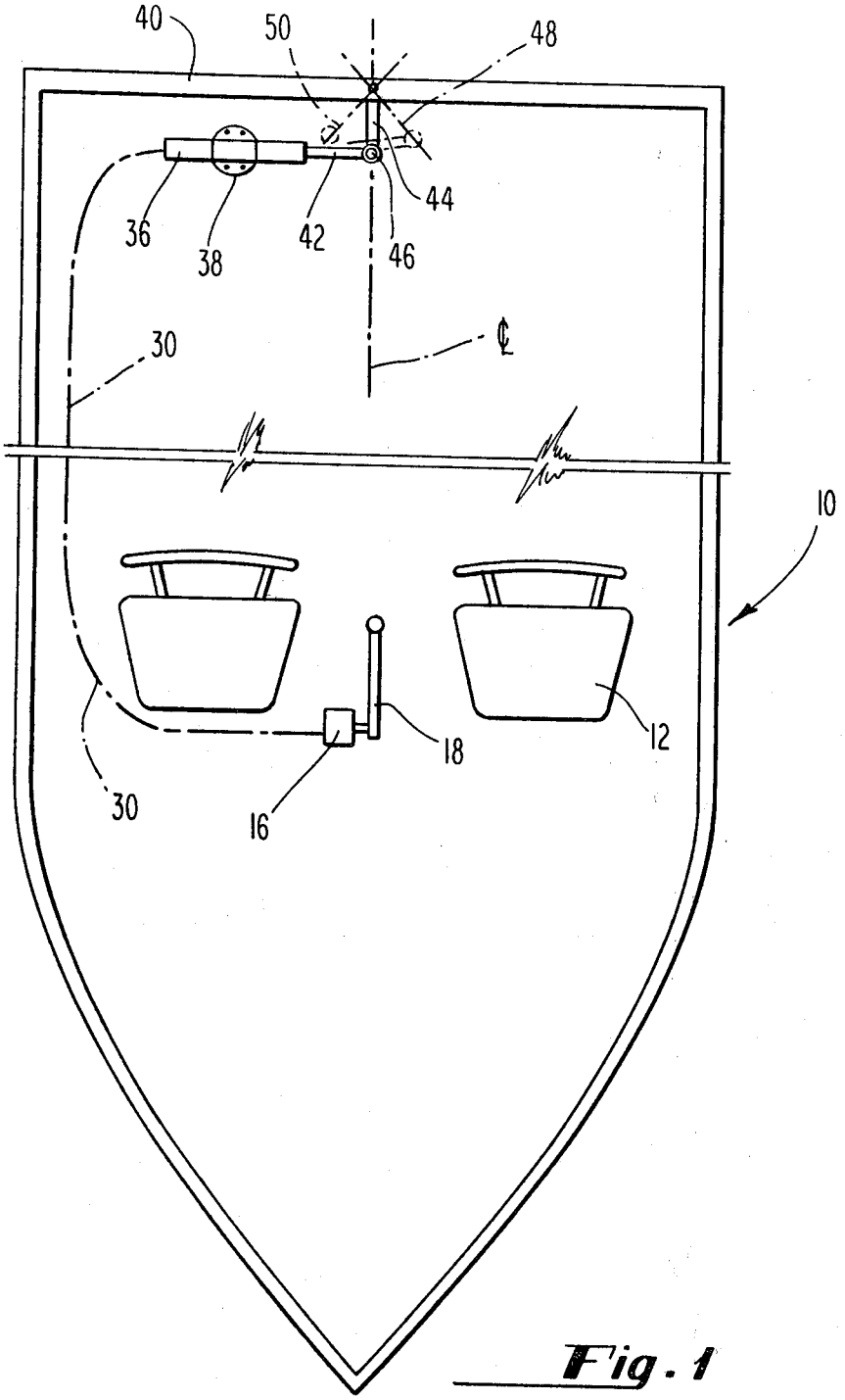
FIG. 1 is a plan view of a marine boat equipped with the stick steering mechanism of the present invention.

In FIG. 1, a boat 10, suitable for trolling, for example, includes a pair of seats 12 mounted in a forward section thereof. A stick steering control mechanism 16 is removably affixed to boat 10 between seats 12 and forward thereof. Stick steering control mechanism 16 includes a steering control stick 18 which may be moved forwardly or rearwardly a total of about 180° which causes encased rotatable flexible shaft 30 to make about 18 complete revolutions due to mechanism contained within mechanism 16, later described. Rotation of flexible shaft 30 is transmitted to a ball screw cylinder 36, or the like, swivelly mounted to bracket 38 affixed to boat 10, on or adjacent transom 40. Ball screw cylinder 36 is conventional and converts rotary motion from rotatable flexible shaft 30 to linear motion, which linear motion is transmitted to an output member 42 for controlling a steering arm 44 through pivot link 46. Steering arm 44 moves the outboard motor (not shown) or a rudder or other steering member (also not shown) by conventional means.

Steering arm 44 is illustrated at its mid-travel position. Dotted lines 48 and 50 indicate the positions of steering arm 44 at its end-travel positions. More specifically, when stick 18 is moved forwardly about 90° from a vertical position, steering arm 44 will assume the position indicated by dotted lines 48 causing boat 10 to travel to the right (starboard) if the screw in ball screw cylinder 36 is provided with a left-hand thread. Conversely, by moving stick 18 to its most rearward position, steering arm 44 will assume the position indicated by dotted lines 50, to thus cause boat 10 to travel to the left (port). When stick 18 is disposed vertically, boat 10 will travel straight forward or backward. If side to side movement of stick steering control mechanism 16 is employed, as illustrated in FIG. 1B, stick movement to the right will cause the boat to travel to the right. Conversely, stick movement to the left will cause the boat to travel to the left. Ball screw cylinder 36 is conventional and is not shown in detail, but typically comprises a nut, a screw which is rotatable relative to the nut, and a plurality of balls disposed in a closed loop around the inner periphery of the nut, or a conventional type Acme screw and nut may be employed. The screw, of course, is free to rotate, but linear movement thereof is restrained. The nut however, connected to output member 42, is restrained from rotating and thus moves linearly as the screw is rotated.

Figure 1A:
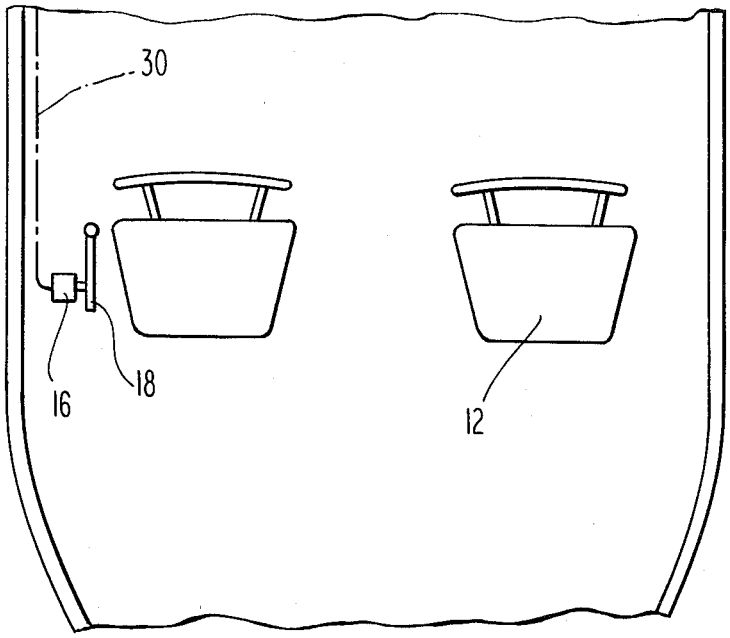
FIGS. 1A and 1B are modifications of the stick steering mechanism of FIG. 1.
Figure 1B:
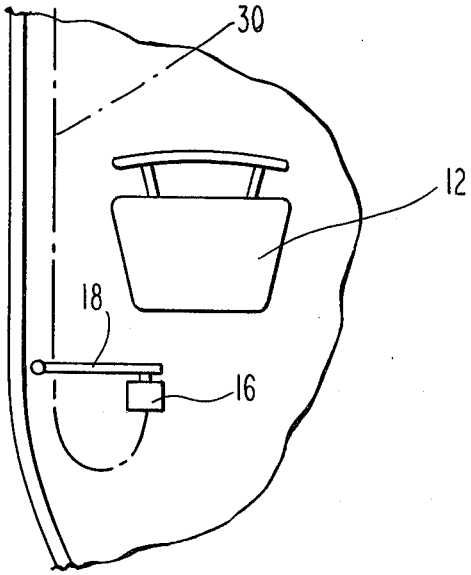
Figure 2:
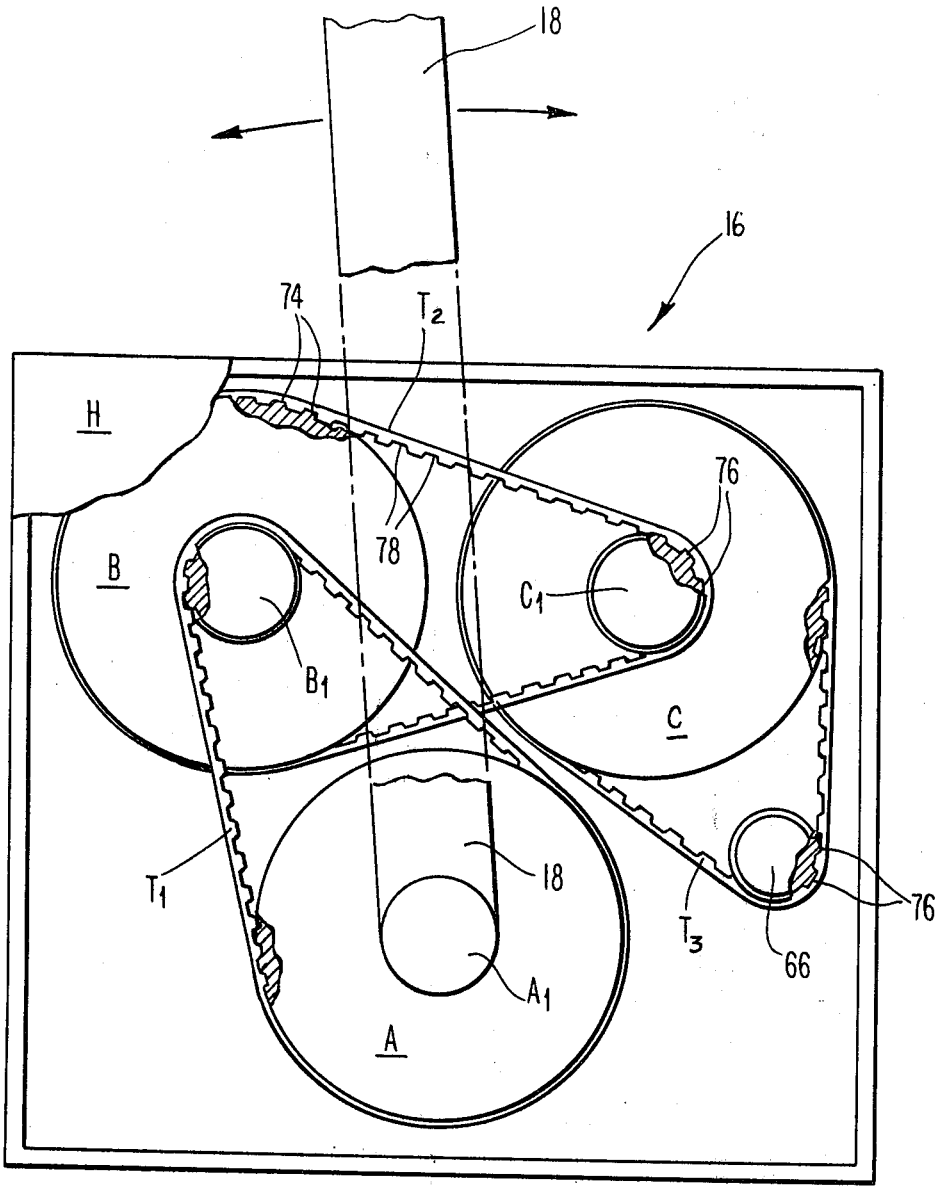
FIGS. 2 and 3 are side and rear elevational views respectively, partially sectioned, of the stick steering mechanism illustrated in FIG. 1, parts broken away and parts omitted for clarity.
Figure 3:
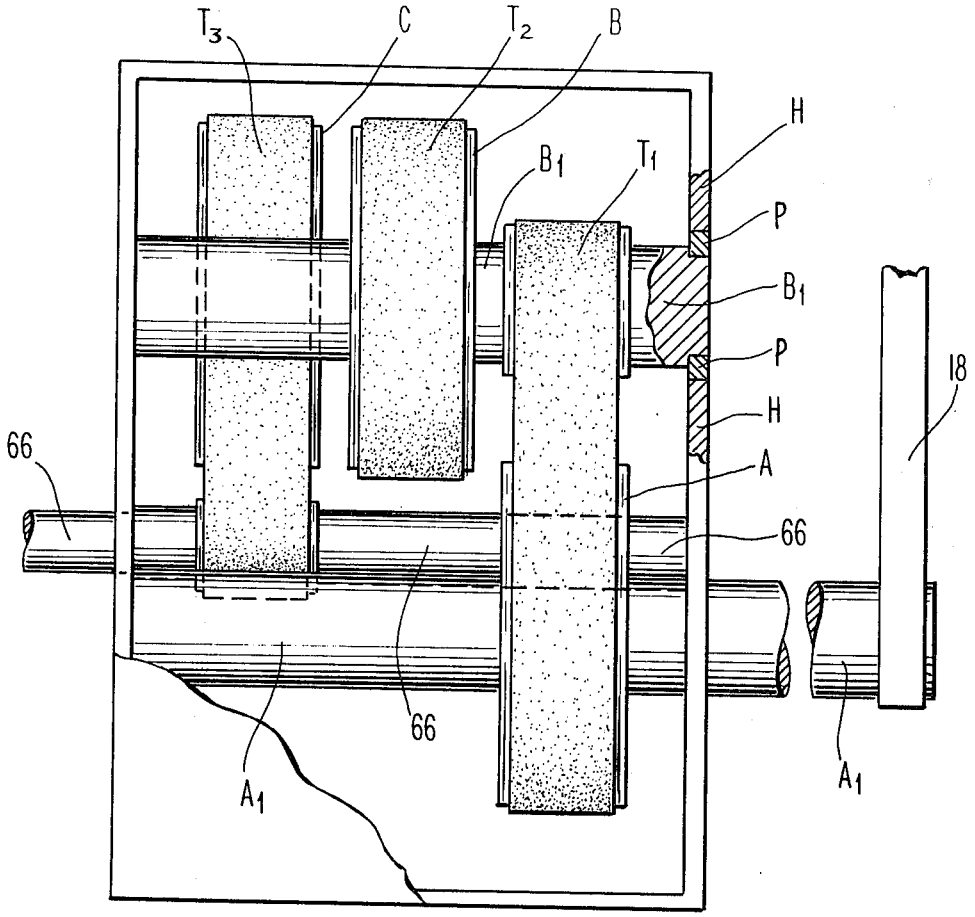
Figure 5:
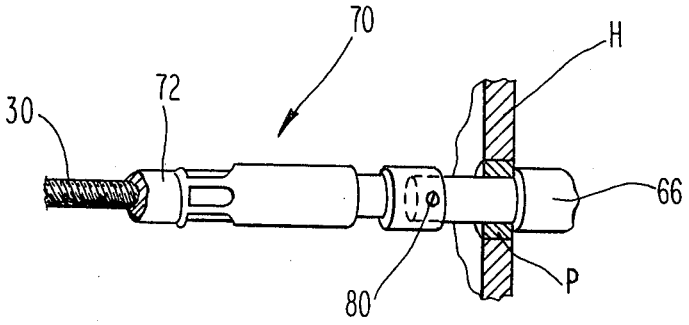
FIG. 5 is a perspective view of a typical rotatable flexible shaft assembly employed with the stick steering mechanism of the present invention.
Figure 4:
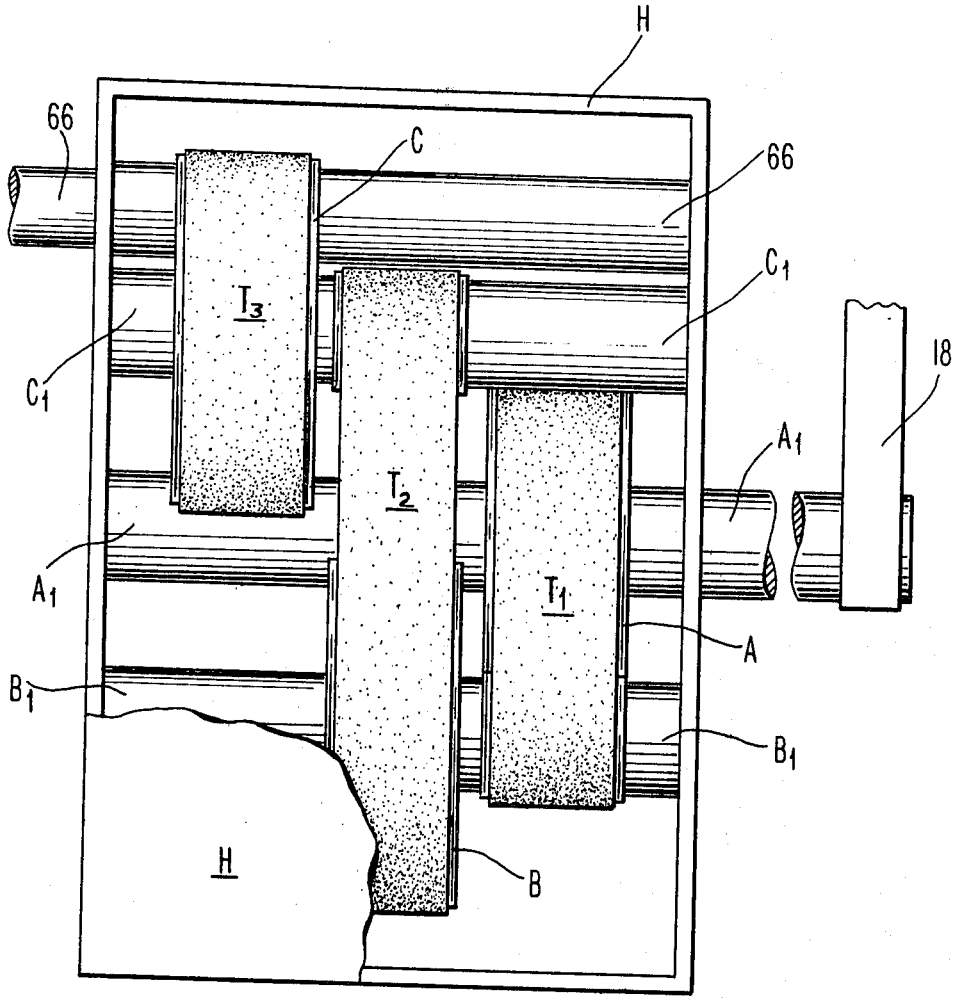
FIG. 4 is a top elevational view of the stick steering mechanism of FIG. 2, parts broken away for clarity.

FIGS. 1A and 1B illustrate stick steering control mechanism 16 mounted at the starboard side. In FIG. 1A, stick 18 is moved forwardly and rearwardly whereas FIG. 1B illustrates stick 18 movable from side to side.

Referring now to FIGS. 2 through 5, stick steering control mechanism 16 comprises 3 pulleys, A, B and C, of equal diameter, having sprocket-spindles $A_1$, $B_1$, and $C_1$, respectively of equal diameter. Timing belt $T_1$ connects pulley A and sprocket-spindle $B_1$. Similarly, timing belt $T_2$ connects pulley B and sprocket-spindle $C_1$. A third timing belt $T_3$ connects pulley C with shaft 66 which rotates flexible shaft 30 by means of a conventional flexible shaft assembly, later described.

Each pulley is contained within an enclosed housing H and the sprocket-spindles each rotate in conventional bearings P, suitably bronze. Sprocket-spindle $A_1$, extends beyond housing H in order that stick 18, secured to sprocket-spindle $A_1$, by conventional security type means, may be readily controlled. Shaft 66 extends through housing H (FIG. 5) and is removably connected to a conventional flexible shaft end fitting assembly 70 which securely holds casing 72 to thus permit flexible shaft 30 to freely rotate therein.

Pulleys A, B and C; as well as sprocket-spindles $B_1$, $C_1$ and shaft 66, are provided with spaced teeth 74 and 76 respectively, which coact with spaced identations 78 provided on each of the timing belts $T_1$, $T_2$ and $T_3$.

Pulleys A, B and C are conveniently 3 inches in diameter. Sprocket-spindles $A_1$, $B_1$, and $C_1$, are conveniently 1 inch in diameter, and shaft 66 is made $\frac{3}{4}$ inches in diameter. Rotation of stick 180° will cause output member 42 to travel about 9 inches, i.e., full left to full right, or vice-versa, depending upon the direction of the threads of the screw in ball screw cylinder 36 or Acme thread screw. More specifically, if the screw is conveniently pitched at 0.500 inches, output member 42 will move approximately $4\frac{1}{2}$ linear inches in either direction when stick 18 is moved or rotated to its most forward or rearward position from vertical, or from its most leftward or rightward position from vertical, as illustrated in the modification of FIG. 1B. If the screw is left-handed, then rotation of stick 18 to a forward or leftward position from vertical will cause boat 10 to travel to the left. Conversely, rotation of stick 18 to a rearward or rightward position from vertical causes boat 10 to travel to the right.

The stick steering control mechanism is compact and may readily be unclamped from boat 10. Thus, the entire unit may then be removed from the flexible shaft end fitting assembly 70 by loosening screw 80 (FIG. 5) to effect disconnection therebetween. This capability of readily removing the entire steering mechanism is expected to decrease the rising incidence of pleasure boat and sport fishing boat thefts.

Most importantly, by eliminating the protruding steering wheel, ample room is provided for both occupants to more conveniently manipulate their fishing gear.

I claim:

1. In a marine vessel steering system wherein gearless steering control means effects rotation of rotatable flexible shaft means for controlling movement of a steering member through screw means which converts rotary motion from said rotatable flexible shaft means to linear motion, said linear motion effecting movement of said steering member which controls direction of travel of said marine vessel, the combination therewith of the improvement comprising a driver pulley rotating in response to movement of said steering control means, at least one pulley driven in response to rotation of said driver pulley, belt means operably interconnecting said driver pulley and said driven pulley whereby said driven pulley rotates a greater number of revolutions than said driver pulley, said steering control means including a steering stick mounted to an input shaft of said driver pulley, said stick unattached to any member at least at one end and adaptably mounted forwardly at an interior side portion of said vessel to permit movement of said stick only forwardly and rearwardly when said stick is mounted for forward and rearward movement and only transversely from left to right or right to left when said stick is mounted for transverse movement whereby movement of said stick forwardly and rearwardly rotates said driver pulley a total of not more than 180°, and movement of said stick transversely said vessel from left to right or right to left rotates said driver pulley a total of not more than 180°, said at least one driven pulley comprising two driven pulleys successively driven in response to rotation of said driver pulley, each of said driver and driven pulleys having a sprocket-spindle, a first belt means operably interconnecting said driver pulley and sprocket-spindle of first of said two driven pulleys, a second belt means operably interconnecting said first driven pulley and sprocket-spindle of second of said two driven pulleys, and a third belt means interconnecting said second driven pulley with an output shaft, said output shaft having a smaller diameter than diameter of said second driven pulley for rotating a greater number of revolutions than said second driven pulley, said rotatable flexible shaft means having one end connected to an end of said rotating output shaft and other end of said flexible shaft connected to said screw means.

* * * * *